United States Patent [19]

Maier

[11] 4,450,120

[45] May 22, 1984

[54] CONCRETE FORM AND METHOD OF ASSEMBLING AND DISMANTLING THE SAME

[76] Inventor: Josef Maier, Schwimmbadstr. 3, D-7611 Steinach, Fed. Rep. of Germany

[21] Appl. No.: 302,378

[22] Filed: Sep. 15, 1981

[30] Foreign Application Priority Data

Sep. 26, 1980 [DE] Fed. Rep. of Germany ..... 3036306

[51] Int. Cl.[3] ..... E04G 11/10

[52] U.S. Cl. ..... 264/31; 249/25; 249/45; 249/195

[58] Field of Search ..... 264/31; 249/9, 23, 30, 249/28, 32, 193, 24, 25, 195, 45

[56] References Cited

U.S. PATENT DOCUMENTS

| | | | |
|---|---|---|---|
| 1,958,933 | 5/1934 | Williams | 249/28 |
| 2,461,733 | 2/1949 | Harder | 249/45 |
| 2,609,585 | 9/1952 | Ledbetter | 249/25 |
| 3,294,357 | 12/1966 | Tooley | 249/28 |
| 3,432,137 | 3/1969 | Krajco | 249/45 |
| 3,630,479 | 12/1971 | Sullivan | 249/28 |
| 4,003,542 | 1/1977 | Beer | 249/32 |
| 4,151,975 | 5/1979 | Williams | 249/193 |
| 4,235,411 | 11/1980 | Maier | 249/193 |

FOREIGN PATENT DOCUMENTS

| | | |
|---|---|---|
| 549159 | 4/1932 | Fed. Rep. of Germany . |
| 1807455 | 10/1969 | Fed. Rep. of Germany . |
| 1813678 | 6/1970 | Fed. Rep. of Germany . |
| 1127987 | 12/1956 | France . |
| 89223 | 12/1954 | Netherlands . |

*Primary Examiner*—John Parrish

*Attorney, Agent, or Firm*—Peter K. Kontler

[57] ABSTRACT

A form for supporting from below a layer of concrete during pouring and hardening has several square or rectangular panels having neighboring marginal portions with downwardly extending reinforcing skirts which are separably connected to each other by bolts. The panels rest on props which must be removed prior to separation of the panels from each other. In order to dismantle the form in the space below the hardened concrete layer, the props for one of the panels are removed and a dismantling device is separably coupled to a panel which is adjacent to the one panel. The dismantling device has a socket below the skirt of the one panel and the one panel is thereupon detached from the panel which carries the dismantling device so that the skirt of the one panel descends into the socket. The one panel is then pivoted with reference to the socketed part of the dismantling device so that its upper side moves away from the underside of the concrete layer. The dismantling device is thereupon transferred to another panel adjacent to a panel which is about to be detached.

41 Claims, 6 Drawing Figures

CONCRETE FORM AND METHOD OF ASSEMBLING AND DISMANTLING THE SAME

BACKGROUND OF THE INVENTION

The present invention relates to concrete forms (i.e., to forms which can be used for the pouring and setting of concrete walls, roofs, ceilings, floors or the like), and more particularly to improvement in the construction and design as well as in the method of assembling and especially in the method of dismantling such forms. Still more particularly, the invention relates to improvements in concrete forms which are or can be utilized with advantage to support the undersides of horizontal or substantially horizontal concrete walls, floors or roofs and embody several panels or boards having surfaces which contact the underside of a concrete wall or the like.

It is known to assemble a concrete form which is used to support a concrete roof from below by resorting to several panels which are connected to each other so as to provide a relatively large plate-like body capable of supporting the plasticized material during pouring as well as during hardening or setting. Once the material sets, the form must be removed for storage or for transfer to another locale of use. As a rule, the panels are mounted on top of props or studs which ensure that the upper sides of the panels are located at the optimum level, namely, at the level of the underside of the roof to be made of concrete or an analogous plasticizable and hardenable material (for the sake of convenience, the invention will be described with reference to the pouring and hardening of concrete walls or the like, it being understood, however, that the same or a similar form can be resorted to for the making of walls, roofs or floors which consist of a plasticizable building material other than concrete). The installation of panels in the area below the concrete roof of a building or another edifice presents fewer problems than the dismantling and removal of the form. Thus, and if the side walls of a structure are readily completed, the form is installed between such side walls and the upper sides of the panels are held at the requisite level prior to pouring of concrete on top of the form. When the concrete hardens, the form must be dismantled in the space below the thus obtained roof, and this can present many problems as regards the removal of props and subsequent detachment of panels from each other preparatory to removal of detached panels from the space below the roof.

In accordance with the presently known proposal, the panels of a concrete form consist of wood and have smooth first sides which face the space for the pouring of concrete as well as second sides which carry reinforcing ribs. The ribs are normally disposed along the marginal portions of the panels. The panels are mounted in specially designed supports or holders which ensure that the smooth first sides of neighboring panels are at least substantially coplanar during pouring and setting of concrete. The holders are provided at the upper ends of props which carry the panels during the pouring of a horizontal concrete ceiling, roof or the like. As a rule, such holders are adjustably mounted on the props or on the heads of the props so that they can be lowered with or detached from the heads prior to removal of panels after hardening of concrete.

It is also known to provide the heads of props with intersecting grooves for reception of adjacent portions of reinforcing ribs at the underside (second sides) of the panels thereabove. The heads preferably diverge upwardly toward the undersides of the panels so as to provide relatively long grooves for and, hence, a better guidance and support of the ribs. Each head can comprise a base plate and an upwardly diverging portion with the aforementioned grooves. The heads are designed in such a way that they can receive portions of ribs on two neighboring panels or portions of ribs at the junction of corners of four neighboring panels. To this end, the grooves of a head may constitute, in their entirety, a composite groove of cruciform shape.

The just discussed conventional forms exhibit a number of serious drawbacks. Thus, each panel must be placed, individually, on top of the corresponding props so that the assembly of the form consumes a substantial amount of time. The situation is aggravated during dismantling of the form because the removal of individual panels from the space below a freshly poured concrete roof or ceiling must be preceded by a lowering or removal of grooved heads. If the heads are merely lowered, they must descend to a level such that the corresponding panel is located below the neighboring panels while its ribs are withdrawn from the grooves of the corresponding heads. It is then further necessary to provide room for removal of the lowered panel by moving such panel sideways, an operation which is quite complex because the neighboring panels continue to rest on the heads of their props (at least during removal of the first panel or panels of the form). This is the reason that the just described conventional forms failed to gain widespread acceptance in the industry. Instead, builders often resort to modified forms whose props carry connectors adapted to be separably connected with the panels. More specifically, the heads of the props support carriers which can be separably coupled with the panels thereabove.

The modified forms also exhibit numerous drawbacks. Thus, four props with corresponding heads and carriers must be installed below each junction of the corners of four neighboring panels so that the positions of the props must be selected with a reasonably high or very high degree of precision. This necessitates resort to skilled labor for work which should be carried out by unskilled or semiskilled workers. Relatively high degree of accuracy is necessary even if each prop supports two or even as many as four holders.

Moreover, many construction sites are configurated, located and/or dimensioned in such a way that the utilization or installation of conventional forms encounters additional problems. For example, it is often necessary to form a concrete roof between and above erected side walls which surround a cavity or hole in the ground so that one cannot resort to the aforementioned props which must rest on the ground, on a floor or an analogous base. The number of carriers which must be used in the aforediscussed modified forms is rather large, i.e., it invariably exceeds the number of panels. This contributes to initial and maintenance cost of the form.

OBJECTS AND SUMMARY OF THE INVENTION

An object of the invention is to provide a novel and improved method of assembling and/or dismantling forms which are used for the pouring and setting of concrete and similar plasticizable building materials.

Another object of the invention is to provide a method which renders it possible to assemble and/or dismantle a concrete form within a very small fraction of the time which is needed to perform such operations in accordance with heretofore known techniques.

A further object of the invention is to provide a method which can be practiced by semiskilled or unskilled construction workers, which reduces the likelihood of injury to attendants and/or damage to component parts of the form and/or to portions of the building, and which can be resorted to irrespective of the size, shape and/or location of the form.

An additional object of the invention is to provide a method which is especially suited for dismantling of concrete or like forms below freshly poured and hardened roofs, ceilings or analogous building parts.

Still another object of the invention is to provide a novel and improved method of dismantling concrete forms of the type wherein the panels exhibit reinforcing or stiffening elements which extend or which can at times extend beyond the concrete-contacting surfaces of such panels.

A further object of the invention is to provide a novel method of assembling and/or dismantling concrete forms which consist of or employ conventional and/or specially designed panels.

An additional object of the invention is to provide a novel and improved form which can be manipulated in accordance with the above outlined method.

A further object of the invention is to provide novel panels for use in the improved form.

Another object of the invention is to provide the form with novel and improved means for temporarily connecting the neighboring panels to each other as well as with novel and improved devices which facilitate convenient, safe and time-saving removal of discrete panels or groups of interconnected panels from the space immediately below a freshly poured and hardened concrete roof, ceiling or the like.

An additional object of the invention is to provide the improved form with novel and improved means for permitting complete removal of props below one or more panels prior to removal of such panel or panels from the form.

Another object of the invention is to provide a relatively simple and inexpensive form which, in addition to certain novel components, can utilize some or a relatively large number of heretofore known components.

An ancillary object of the invention is to provide a form which employs or which can employ a relatively small number of rather simple component parts so that its space requirements during erection, transport and/or storage are much more satisfactory than those of heretofore known forms.

A further object of the invention is to provide the form with novel and improved devices which allow for removal of discrete panels or groups of interconnected panels from a partially or fully erected form in a small area, with a minimum of effort and (if desired or necessary) with resort to readily available lifting and transporting equipment.

Another object of the invention is to provide a method and an apparatus which allows for convenient, safe and time-saving removal of a first or foremost panel as well as of each following panel up to and including the last panel or panels.

A further object of the invention is to provide a novel and improved form which can be assembled, at least to a substantial degree, outside of the actual locale of use so that such assembly can be effected more rapidly and efficiently (e.g., due to resort to cranes and/or other heavy-duty equipment) than within the confines of a partially erected building or the like.

One feature of the invention resides in the provision of a method of manipulating (assembling and/or dismantling) the panels of a concrete or like form which comprises at least two panels having adjacent separably connected or connectable marginal portions and being mounted on top of props at a locale for use during pouring of concrete or other plasticizable building material onto the form. The method comprises (for the purpose of dismantling the form) the steps of removing each prop for one of the panels, separating (if necessary) the marginal portion of the one panel from the adjacent marginal portion of the other panel, lowering the marginal portion of the thus separated one panel with reference to the other panel, and thereupon pivoting the one panel downwardly and away from the other panel about an axis which is located in the general area and is substantially parallel to the one marginal portion of the one panel. The method preferably further comprises the step of supporting the marginal portion of the one panel from below in the course of the pivoting step.

The method can further comprise the steps of assembling the panels of the form at a location other than the locale of use including placing the panels upside down (e.g., onto the ground, onto a floor or onto another support), separably connecting the marginal portions of neighboring panels to each other to form at least one section or group consisting of a plurality of interconnected panels, erecting the props for the panels of such group at the locale of use, inverting the group, and placing the inverted group on top of the props at the locale of use. The assembling step precedes or follows the aforediscussed dismantling steps and can include forming at least two sections or groups; the placing step then preferably includes establishing a certain clearance or gap between such groups at the locale of use.

The form can comprise and normally comprises more than two panels, and such panels can include a lightweight panel (namely, a panel whose weight is less than that of the other panels). The method then preferably further comprises (for the purpose of completely dismantling the form) the step of removing from the locale of use all remaining panels of the form subsequent to removal of the one panel, and such removing step then preferably includes removing the lightweight panel subsequent to removal of all other panels.

If the form comprises more than two panels, the method can comprise the additional steps of removing the props for at least one additional panel which is preferably adjacent to the one panel, disconnecting the additional panel from each neighboring propped panel of the form, lowering as least one marginal portion of the additional panel simultaneously with lowering of a marginal portion of the one panel (such marginal portions can be adjacent to and aligned with each other), and pivoting the additional panel about an axis which is adjacent and at least substantially parallel to the one marginal portion thereof (such axis can coincide with the pivot axis for the one panel) simultaneously with pivoting of the one panel.

The method can further comprise the step of reinforcing at least certain marginal portions of panels in the form or of assembling the form from panels having reinforced marginal portions. The reinforcing can involve the application of elongated flanges, skirts or strips to the marginal portions of the panels. Additional reinforcing structure can be applied to each panel within the confines of the marginal reinforcements at that side of each panel which is not contacted by plasticizable material.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
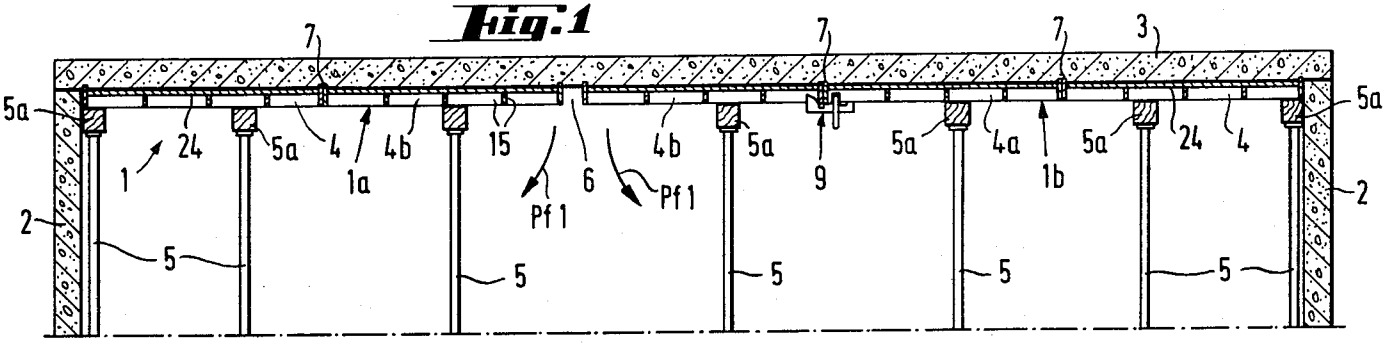
FIG. 1 is a schematic vertical sectional view of a set of concrete walls and of a form which is constructed and assembled and can be dismantled in accordance with a first embodiment of the invention.

Referring first to FIG. 1, there is shown a form or mold 1 which serves to support a horizontal concrete layer or roof 3 during pouring and hardening or setting. The form 1 is installed in a structure whose side walls 2 are already standing and such form is removed as soon as the material of the roof 3 sets so that it need no longer be propped from below.

The form 1 comprises a plurality of polygonal (preferably square or rectangular) boards or panels 4 (see also FIG. 2) which are assembled in a checkerboard pattern and are supported from below by several upright props 5, preferably in the form of vertical beams or studs forming several rows between the rows of neighboring panels 4. The upper end portions of the props 5 carry horizontal squared timbers of beams 5*a* which directly support the undersides of the adjacent panels 4.

The form 1 exhibits a clearance or gap 6 whose purpose is to facilitate removal of the adjacent panel or panels 4, especially during the initial stage of dismantling of the form 1. During pouring of concrete and subsequent setting of the poured material, the gap 6 is filled with one or more pieces or strips of asbestos, cement, wood or another suitable material. Such filler pieces allow for rapid exposure of the gap 6 when the setting of concrete is completed and thereby allow for more convenient removal of panels 4 which flank the gap. Reference may be had to my copending application Ser. No. 278,093 filed June 29, 1981 for "Board for use in concrete forms or the like" which discloses a board capable of filling the gap 6 and of allowing rapid removal of its components prior to dismantling of the form including the panels 4.

In accordance with the improved method, the form 1 is further provided or associated with means which allow for rapid and convenient removal of the panels 4, either individually or in the form of groups or sections each of which consists of several interconnected panels. FIG. 1 shows a first group or section 1*a* at one side and a second group or section 1*b* at the other side of the gap 6. Moreover, it is further possible to assemble the entire form 1 or at least its sections (such as 1*a* and 1*b*) prior to installation in the space between the side walls 2 so that the assembly of the entire form 1 takes much less time than if all of the panels 4, props 5 and beams 5*a* had to be assembled within the confines of the walls 2. For example, each of the sections 1*a* and 1*b* can be fully assembled at a location adjacent to but outside of the confines of the walls 2, and such sections are thereupon lifted by a crane and inserted into the space between the walls 2 to define the aforementioned gap 6 which is temporarily filled, e.g., in a manner as disclosed in the aforesaid copending application Ser. No. 278,093, prior to pouring of concrete. The props 5 and beams 5*a* can be set up in the space between the walls 2 prior to placing of the section 1*a*, 1*b* onto the beams 5*a*.

The individual panels 4 are connected to each other by bolts 8, screws or analogous fasteners which extend through the aligned holes or bores 31 of neighboring primary reinforcing elements in the form of flanges or skirts 7 constituting integral or removable parts of the panels. The manner in which a bolt 8 separably connects the skirts 7*a* and 7*b* of two neighboring panels 4*a* and 4*b* can be readily seen in FIG. 3 wherein the abutting skirts 7*a*, 7*b* are shown in a vertical sectional view. The skirts extend along all marginal portions of the respective panels 4 (note FIG. 2) and the space within the confines of such skirts is traversed, in criss-cross fashion, by additional or auxiliary reinforcing elements 15 in the form of elongated ribs or webs which extend downwardly, e.g., to the same extent as the skirts 7 (note FIG. 3 which shows that the undersides or lower edge faces 22 of the ribs 15 are flush with the undersides or lower edge faces 11 of the skirts 7).

A special area or location in immediate or close proximity to the locale of use can be selected for assembly of the groups or sections 1*a* and 1*b* prior to the placing of such sections on top of the beams 5*a* which are already secured to the upper end portions of the props 5. As mentioned above, such assembling of relatively large sections 1*a* and 1*b*, each of which consists of or includes a relatively large number of discrete panels 4, contributes significantly to a reduction of the time which is needed for completion of the form 1. The same holds true for dismantling of the form 1, i.e., by resorting to the method and apparatus of the present invention, one can dismantle the form by the simple expedient of removing an entire section 1*a* or 1*b* at a time with attendant savings in time when compared with a procedure which would involve removal of successive panels 4, one after the other, in the heretofore known manner. Even if the dismantling involves removal of certain individual panels or smaller groups of e.g., two or three, interconnected panels at a time plus removal of one or more larger groups of panels at a time, this modified method still exhibits pronounced advantages over the heretofore known methods which involve sequential removal of discrete panels. The same applies, of course, for assembly of the form, i.e., the form 1 can be assembled in part of one or more sections each of which consists of or includes two or more panels as well as of a requisite number of individual panels 4. In many instances, the extent to which the panels 4 can be assembled into larger groups or sections prior to placing on top of the beams 5*a* will depend on the dimensions of the roof 3, on the nature of equipment which is available for transfer of entire sections into and from the space within the walls 2, on the dimensions of individual panels, on the dimensions of the space which is available or allotted for assembly of sections outside of the walls 2 or on a combination of such parameters.

Figure 3:
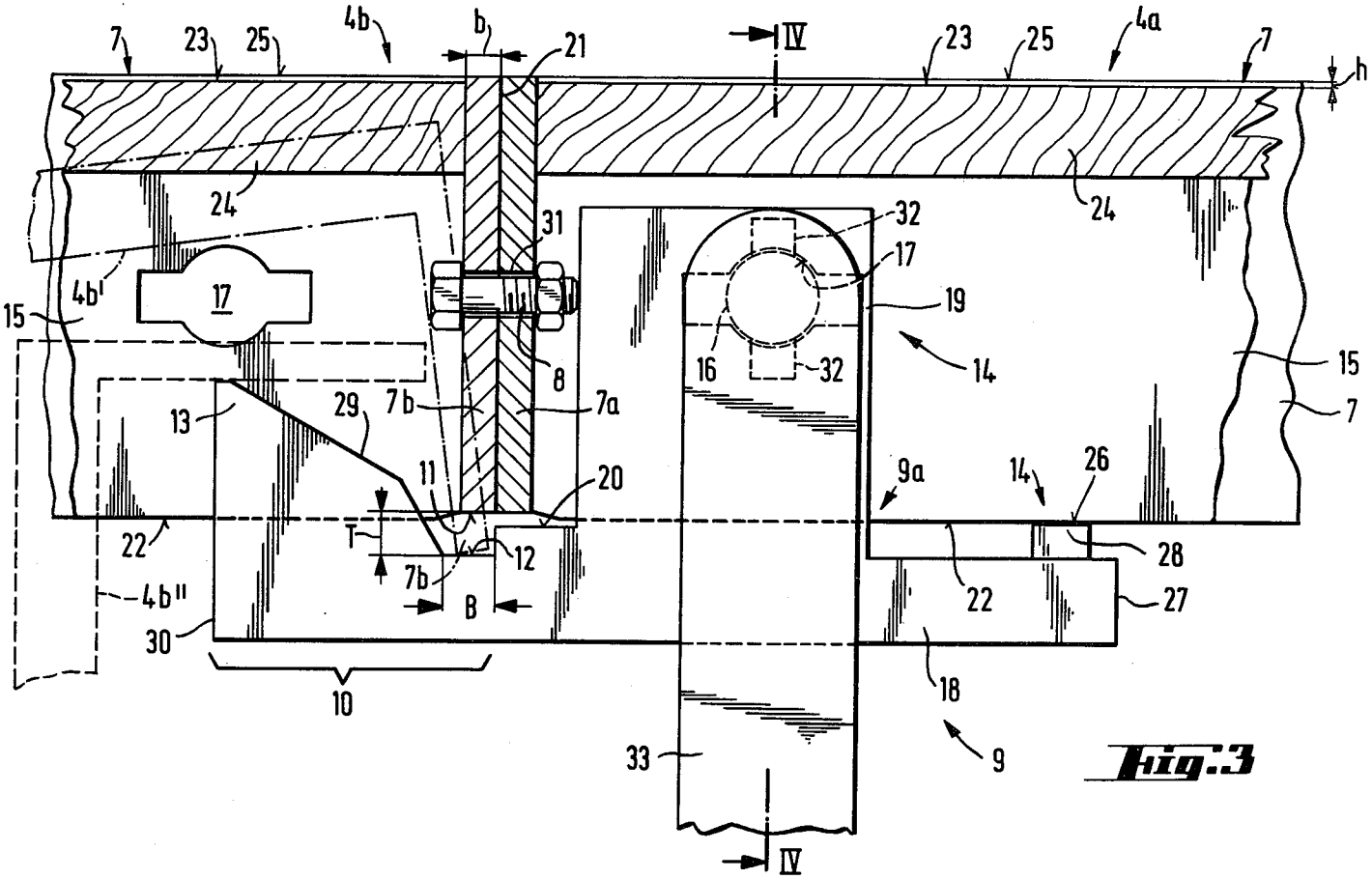
FIG. 3 is an enlarged vertical sectional view of a detail of the form of FIG. 1.

In order to dismantle the form 1, one begins with a panel 4 (such as 4*b*) which is adjacent to the gap 6 (it is to be borne in mind that the panels 4 can be assembled into three or more groups or sections, i.e., the form 1 can be provided with two or more gaps 6, each extending between two neighboring sections). A panel (4*a*) which is adjacent to the first-to-be-removed panel 4*b* and which is still fixedly held in position below the freshly poured and hardened concrete roof 3, is connected with at least one novel dismantling device 9. The latter comprises a first unit 9*a* which is separably connectable with and is located at the underside of the (still) fixedly mounted panel 4*a*. The dismantling device 9 further comprises a second unit 10 which constitutes an abutment and is located at a level below the adjacent portion (underside) of the panel 4*b* when the unit 9*a* is properly attached to the panel 4*a*. Prior to starting with removal of the panel 4*a*, the skirts 7*a* and 7*b* of the neighboring panels 4*a*, 4*b* are still fixedly but separably connected to each other by one or more fasteners 8 in a manner as shown in FIG. 3. The boundary between the units 9*a* and 10 of the dismantling device 9 is located or in close to the plane 21 where the skirts 7*a* and 7*b* meet, and that part of the unit 10 which is immediately adjacent to the unit 9*a* (i.e., which is located at a level below the underside 11 of the skirt 7*b*) has a recess or socket 12 whose bottom surface is located at a distance T from the underside 11 of the skirt 7*b* while the latter is still fixedly connected to the adjacent skirt 7*a*. As mentioned above, the underside 11 of the skirt 7*b* is coplanar with the underside 11 of the skirt 7*a* as well as with the undersides 22 of the reinforcing ribs 15 at the undersides of the panels 4*a* and 4*b*.

The unit 10 of the dismantling device 9 further comprises a camming portion or fulcrum 13 which is adjacent to the socket 12 and along which the skirt 7*b* can pivot, roll or turn from the solid-line position to the broken-line position 7*b*", namely, about a horizontal axle which is parallel to the skirt 7*b*. The phantom-line position 7*b*' is an intermediate position of the skirt 7*b* which the latter assumes subsequent to removal of the fastener 8 and upon descent of its underside 11 into the socket 12. The camming portion of fulcrum 13 extends all the way to the left-hand end face 30 of the unit 10, as viewed in FIG. 3 of the drawing.

Each of the panels 4 can be provided with a coupling portion 14 which serves to secure a dismantling device 9 to the respective panel. The coupling portions 14 may constitute component parts of or may be affixed to selected reinforcing ribs 15 of the respective panels 4. If desired, the dismantling devices 9 can be permanently secured to the respective panels 4, for example, by welding of the portions 9*a* to the selected reinforcing ribs 15 (as a role, the devices 9 and the ribs 15 will consist of metallic materials and such materials are then selected with a view to facilitate the establishment of a reliable bond therebetween). However, it is preferred, at this time, to establish separable connections between the coupling portions 14 of the panels 4 and the dismantling devices 9. The connections can be established by means of horizontal bolts 16 (see FIGS. 3 and 4) extending through suitably configurated ("winged") openings or holes 17 of the reinforcing ribs 15. Each rib 15 can have up to four openings 17. The unit 9*a* of each dismantling device 9 comprises a laterally (upwardly, as viewed in FIG. 3 or 4) extending portion or arm 19 the lower end portion of which is rigid or integral with a carrier element 18 on the corresponding portion 9*a*. The arm 19 is substantially parallel to the adjacent reinforcing rib 15 when the dismantling device 9 is properly mounted on such rib. The bolt 16 is supported by the upper portion or upper end portion of the arm 19. Each such bolt 16 is rotatable with respect to but is preferably not detachable from the associated arm 19 so as to prevent accidental losses and delays in assembly of the form 1. The upper side or surface 20 of the carrier element 18 can extend all the way to the plane 21 of contact between the neighboring skirts 7*a* and 7*b*, and this surface 20 can be located at or close to the level of the undersides or lower edge faces 22 of the reinforcing ribs 15. All that counts is to ensure that the skirt 7*b* can descend to the position 7*b*' preparatory to removal from the region below the roof 3, i.e., that the dismantling device 9 provides a socket or recess 12 into which the lowermost portion of the skirt 7*b* can descend prior to rolling along the camming portion 13 of the unit 10. The socket 12 extends down to a level below the undersides 22 of the reinforcing ribs 15.

When the props 5 and the beams 5*a* which support the panel 4*b* are removed, and when the fasteners 8 which connect such panel to the neighboring panels 4 and 4*a* are also removed, the panel 4*b* descends by gravity and the lowermost part of its skirt 7*b* enters the socket 12, i.e., the skirt 7*b* descends through the distance T and comes to rest on the bottom surface in the recess 12. As mentioned above, the corresponding position of the skirt 7*b* is shown in FIG. 3 by phantom lines, as at 7*b*'. This renders it possible to remove the panel 4*b* by moving the skirt 7*b* from the position 7*b*' to the position 7*b*", i.e., by causing the left-hand side of the skirt 7*b* to roll along the camming portion 13 of the unit 10. Once the skirt 7*b* assumes the position 7*b*", the major part of the respective panel 4*b* is located in or close to a vertical plane (this is shown at 4*b*") and the panel 4*b* can be readily removed from the region below the roof 3.

It will be noted that removal of a selected panel (such as 4*b*) need not be preceded by lowering of the corresponding prop or props 5 and/or beams 5*a*, i.e., the parts 5 and 5*a* can be simply removed from the space below the panel 4*b* and the latter is thereupon ready to be removed by the simple expedient of removing the corresponding fasteners 8 so that the skirt 7*b* can descend into the socket 12 (note the position 4*b*' of the panel 4*b*) and is thereupon pivotable about the camming portion 13.

The just described mode of removing the panel 4*b* is especially advantageous when the panels are constructed in such a way that their skirts extend upwardly and beyond the concrete-contacting upper sides 23 of the major portions or boards 24 of the panels. This can be seen in FIG. 3 wherein the uppermost portions of the skirts 7*a* and 7*b* extend upwardly of and slightly beyond the coplanar upper sides 23 of the boards 24 of the respective panels 4*a* and 4*b*. Such positioning of the skirts 7*a*, 7*b* is not unusual because the skirts are likely to shift positions and/or expand in response to changes in temperature, moisture content and/or a combination of such influences. Therefore, many makers of panels intentionally construct the panels in such a way that the upper edge faces 25 of the skirts 7 extend beyond the concrete-contacting sides 23 through a relatively small distance (shown at h in the upper right-hand portion of FIG. 3). The major portion or board 24 of each panel 4 normally (but not necessarily) consists of wood. The provision of skirts 7 which extend upwardly beyond the surfaces or sides 23 of the respective boards 24 is advisable in order to ensure that the underside of the roof 3 is not formed with downwardly extending ribs such as could develop if the upper sides 25 of the skirts 7 were located (e.g., in response to thermally induced contraction or as a result of a reduction of moisture content) at a level below the surfaces 23. Any ribs at the underside of the roof 3 would be unsightly and their removal would necessitate a substantial amount of work as well as the use of expensive and complex equipment. On the other hand, the shallow grooves which are or may be formed in the underside of the roof 3 by the upwardly extending upper end portions of the skirts 7*a*, 7*b* can be readily filled in with a minimum of effort and with little loss in time.

It has been found that the aforedescribed mode of removing the panels 4 at the underside of the roof 3 constitutes a substantial simplification of dismantling the form 1 and a substantial improvement over the previously outlined conventional techniques. The depth T of the recess or socket 12 in the unit 9*a* of each of the dismantling devices 9 is selected in such a way that it at least slightly exceeds the distance h. For example, the depth T can be in the range of a few millimeters, preferably close to or exactly 8 mm. This depth is further selected with a view to allow for convenient pivoting or tilting of the panels about the camming portions 13 of the respective dismantling devices 9.

In addition to the bolts 16, the means for connecting and locating the dismantling devices 9 with reference to the associated reinforcing ribs 15 may comprise upwardly extending projections or lugs 26 which are provided on the carrier elements 18 and abut against the undersides or lower edge faces 22 of the respective ribs 15. As can be readily seen in FIGS. 3, 4 and 5, the projections 26 are located at or close to those ends of the respective units 9*a* which are remote from the sockets 12, namely, which are disposed at or close to the corresponding end faces 27 of the dismantling devices 9. The projections 26 can be welded or otherwise fixedly secured to the carrier elements 18 so that they extend laterally thereof (see FIG. 4) and below the undersides 22 of the adjacent ribs 15. The longitudinal directions of the projections 26 are or can be substantially parallel to the axes of the respective bolts 16. Each of these projections may constitute an integral portion 28 of the respective carrier element 18. By extending below the underside 22 of the rib 15, the projection 26 of each dismantling device 9 cooperates with the associated bolt 16 to hold the device 9 against pivoting with reference to the respective panel 4.

Figure 5:
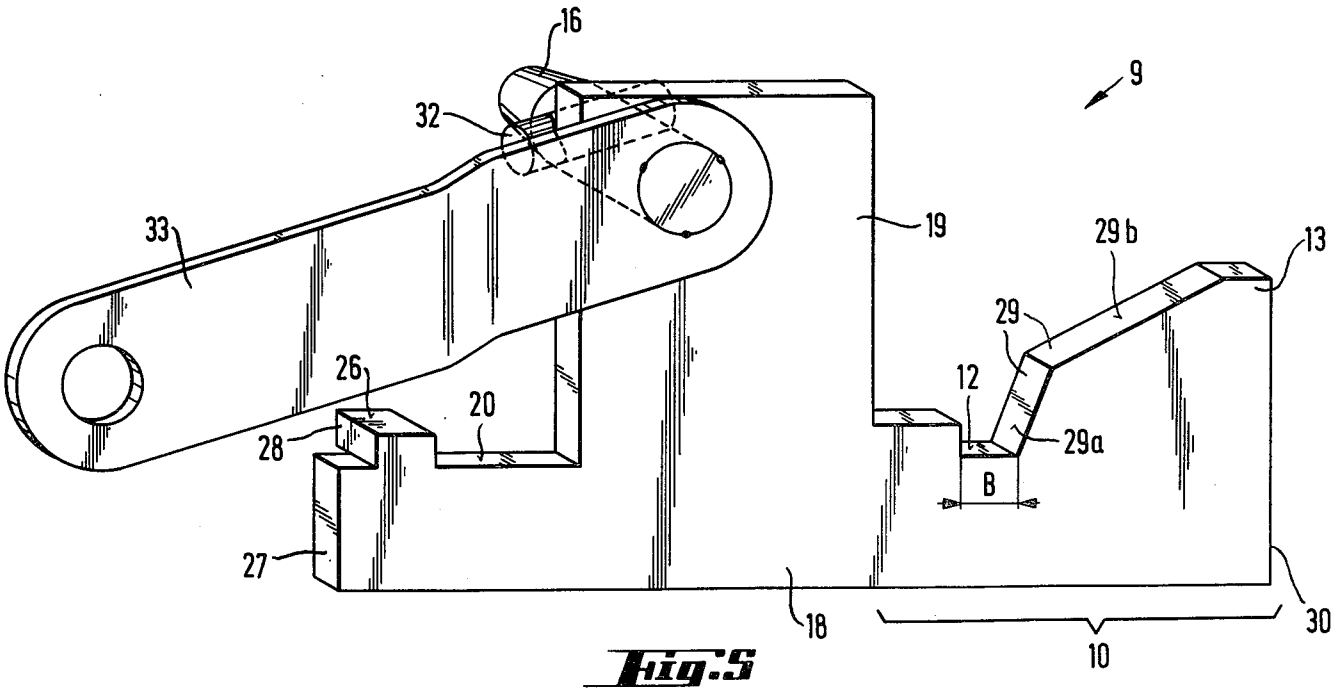
FIG. 5 is a perspective view of the dismantling device which is shown in FIGS. 1, 3 and 4.

The face 29 of the camming portion 13 (see FIG. 5) can be convex (i.e., it may be curved all the way from the recess or socket 12 to the end face 30) or, and as actually shown in FIGS. 3 and 5, the face 29 may consist of several flat portions or segments which make relatively large obtuse angles with one another. The portion or segment 29*a* which is immediately adjacent to the socket 12 is preferably steeper than the other portion(s) or segment(s) 29*b*. Also, the width or thickness b of a skirt 7 is preferably somewhat less than the width B of the socket 12 therebelow (see FIG. 3). This reduces the likelihood of jamming or analogous problems during removal of the panels 4 from the space below the roof 3. Moreover, such construction or dimensioning of the parts 7 and 9 ensures convenient and rapid removal of panels 4 with a minimum of effort because the panels (such as the panel 4*b* of FIG. 3) encounter little or no resistance to movement from the intermediate positions (4*b*′) to the positions (4*b*″) in which the panels are ready for removal in their entirety.

The form 1 can be assembled of the heretofore described panels 4 as well as of a variety of other types of panels, e.g., those which are normally employed for the pouring of concrete in upright cavities (such as are needed to form the walls 2 shown in FIG. 1). In other words, it is not necessary that the panels 4 be specifically designed for use in assembling the sections 1*a*, 1*b* of the form 1; all that counts is to provide such panels with openings 17 for reception of the connecting bolts 16 and that the skirts 7 or analogous reinforcing elements of the panels be provided with registering openings 31 for the fasteners 8 which temporarily secure neighboring skirts to each other while the form must support a freshly poured roof 3. Thus, any panels which are used in the making of concrete foundations, walls, roof or the like can be used for the practice of the present invention, as long as they are provided with the necessary features for connecting them to each other and to the dismantling devices 9. This reduces the cost of erecting a concrete structure because the panels which are used for the pouring of upright walls can be used with equal advantage for the pouring of horizontal bottom or ceiling (roof) walls, as long as they satisfy the rather minimal requirements which are outlined above and which enable the dismantling devices 9 to be put to use in the aforedescribed manner. The increased versatility of panels, which may be of conventional design, is attributable to the provision of the novel method and to the provision of the improved dismantling devices which enable the attendants to rapidly dismantle a fully erected form within a fraction of the time that is needed for the dismantling of conventional forms, i.e., of forms which can use the panels of FIGS. 1 to 4 but do not embody or do not utilize the improved dismantling devices 9.

Figure 4:
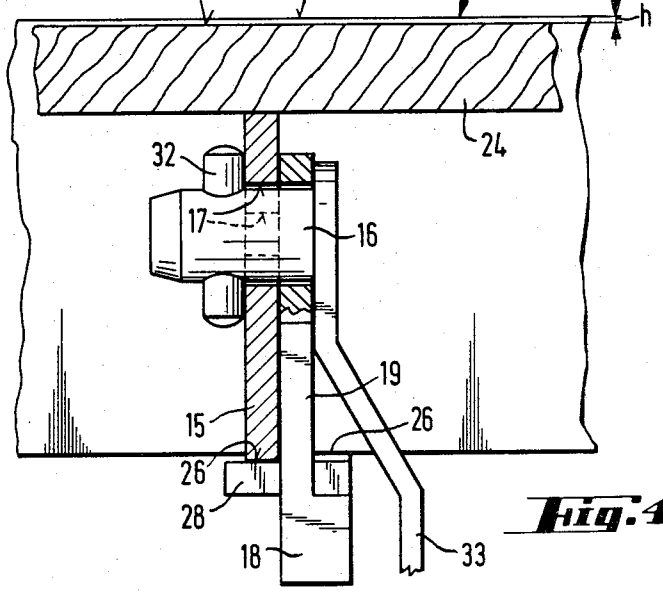
FIG. 4 is a sectional view as seen in the direction of arrows from the line IV—IV of FIG. 3.

FIGS. 3 to 5 show that the bolts 16 can be releasably secured in the openings 17 of the reinforcing ribs 15 by diametrically extending locking pins 32. The straight pins 32 can be replaced by cotter pins or any other suitable removable or permanently installed locking devices which prevent accidental detachment of dismantling devices 9 from the respective ribs 15. The configuration of each opening 17 is such that a bolt 16 with a diametrically extending locking pin 32 can be inserted therethrough in one angular position of the bolt 16 and that the bolt can thereupon be turned (e.g., through 90 degrees) to enable its pin 32 to lock the arm 19 of the dismantling device 9 to the respective rib 15. The outline of a suitable opening 17 can be seen in the rib 15 which forms part of the panel 4*b* shown in the left-hand portion of FIG. 3. The right-hand portion of FIG. 3 and FIG. 4 show a bolt 16 in connecting position, i.e., the locking pin 32 is vertical or nearly vertical so that it prevents the arm 19 from moving away from the adjacent rib 15. The distance between the locking pin 32 and the arm 19 can be selected in such a way that it only slightly exceeds or equals the thickness of a rib 15, i.e., that the arm 19 is held in or close to surface-to-surface contact with the rib 15 when the locking pin 32 is moved to the angular position of FIG. 4. In such position of the arm 19, the projection or lug 26 abuts against the underside 22 of the respective rib 15 to thus prevent undesirable angular displacements of the dismantling device 9.

The means for moving the bolt 16 between two predetermined angular positions, namely, between the position in which the locking pin 32 can extend through an opening 17 and the position in which the pin 32 locks the respective dismantling device 9 to the rib 15, comprises an actuating lever 33 which is adjacent to the outer or exposed side of the arm 19 and is rigidly connected to or made integral with the bolt 16. The arrangement is preferably such that the actuating lever 33 is substantially horizontal when the locking pin 32 extends horizontally, i.e., that the tendency of the lever 33 to assume the position of FIG. 5 by gravity entails automatic locking arrangement between the pin 32 and the adjacent rib 15. The just discussed mode of connecting the bolt 16 with the lever 13 is desirable and advantageous because the pin 32 then tends to assume its locking or operative position and is free to pass through the corresponding opening 17 only when an attendant so desires. Thus, the provision of an actuating lever 33 which locks the dismantling device 9 to the rib 15 under the action of gravity contributes to simplicity and safety of the form 1 because the panels 4 are highly unlikely to become accidentally detached from the associated dismantling devices 9, or vice versa. At the very least, once the lever 33 is moved to the angular position of FIG. 3 (either by gravity or by hand), it remains in such position under the action of gravity so that there is no need to provide auxiliary or additional locking means in order to ensure that the lever 33 will be prevented from accidentally leaving such position. Since the panels 4 are or can be relatively large and heavy, an accidentally released panel could injure the person or persons standing therebelow. Moreover, such mounting of the lever 33 practically excludes the possibility that a descending panel 4 could be damaged or destroyed because the panel descends only when an attendant so desires. Also, the panel or panels are less likely to damage any other parts of the form 1 and/or the floor therebelow.

Figure 2:
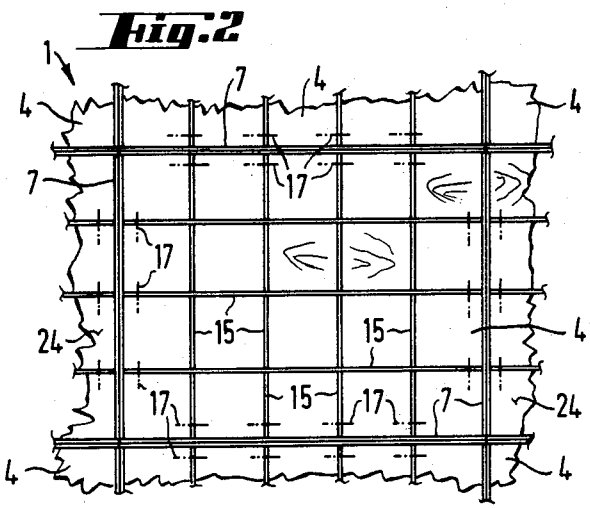
FIG. 2 is a fragmentary bottom plan view of the form of FIG. 1.

FIG. 2 is a bottom plan view of an entire panel 4 and a fragmentary bottom plan view of eight additional panels 4 which surround the centrally located panel. It will be readily seen that the panel 4 which is shown in its entirety (and which is preferably identical with the surrounding panels) has a rectangular outline with three parallel equidistant reinforcing ribs 15 extending horizontally, as viewed in FIG. 2, and four equidistant parallel reinforcing ribs 15 extending vertically, as viewed in FIG. 2. The areas between the intersecting horizontal and vertical ribs 15 may but need not be square. All four marginal portions of each panel 4 are provided with skirts or flanges 7, and each rib 15 is provided with a pair of openings 17, one close to each of its ends. Such openings 17 are adjacent to the respective skirts 7. As a rule, it suffices to provide a relatively small number of dismantling devices 9, e.g., two dismantling devices which are attached to a panel that is adjacent to the panel about to be removed, which are thereupon detached from the respective fixed panel and secured to another fixed panel adjacent to a panel to be removed, and so forth. Of course, one can employ a larger number of dismantling devices 9 (e.g., four devices 9, two for each of two fixed panels 4) to allow for simultaneous removal of two or more panels 4. For example, an attendant may decide to utilize a total of six dismantling devices 9 and to attach, in a first step, two devices 9 to the centrally located uppermost panel 4, two devices 9 to the central (fully shown) panel 4, and two devices 9 to the centrally located lowermost panel 4 of FIG. 2 so that the units 10 of the six dismantling devices are respectively located below the uppermost leftmost panel 4, below the central leftmost panel 4 and below the lowermost leftmost panel 4 of FIG. 2. This renders it possible to simultaneously remove all three leftmost panels 4 by causing their right-hand skirts 7 to descend into the respective sockets 12 and thereupon causing such leftmost panels to pivot (see the arrows Pf1 in FIG. 1) about the corresponding camming portions 13. In the next step, the six dismantling devices 9 are transferred onto the three rightmost panels 4 of FIG. 2 to allow for simultaneous removal of the three centrally located panels 4.

Referring to FIG. 1, the dismantling can proceed at both sides of the gap 6 which is disposed between the sections 1*a* and 1*b* of the form 1. Thus, one can remove panels from the section 1*b* simultaneously with removal of panels 4 from the section 1*a*. This necessitates the utilization of a sufficient number of dismantling devices 9, e.g., a total of four if the attendants desire to simultaneously remove one panel from the section 1*a* and one panel from the section 1*b*. The devices 9 can be reused as often as desired, and their initial cost is very reasonable. Moreover, the wear upon such devices is practically nil and, if it develops, the wear does not immediately affect their operation and/or usefulness. If the component parts of the form 1 are put into storage, the panels 4 can be stacked on top of each other or they may be placed one next to the other in vertical or nearly vertical planes. The dismantling devices 9 cannot be readily misplaced because an attendant simply attaches these devices to the ribs 15 of the outermost panel 4 and the levers 33 automatically ensure that the devices 9 cannot be accidentally detached from the respective panel. The same holds true for the transport of panels 4 and devices 19 to different locales of use.

In accordance with a presently preferred embodiment of the improved method, the form 1 includes at least one lightweight panel 4, i.e., a panel whose weight may be a relatively small fraction of the weight of other panels 4. This is desirable and advantageous because the lightweight panel can be placed in a position such that it is the last panel to be removed during dismantling of the form. The last panel can be readily removed by an attendant or by two attendants. Alternatively, the last panel can be removed by a forklift, a small crane or any other contrivance which is capable of grasping and transporting panels, plates or the like. The last panel (especially a lightweight panel) can be readily removed without assistance from one or more dismantling devices 9 and/or other auxiliary equipment. The just discussed lightweight panel may constitute an extremely simple (specially designed or conventional) panel, e.g., a panel which is customarily employed in the making of concrete foundations or the like, as long as such panel has openings 17 for the bolts 16 and locking pins 32 so that it can support one or more dismantling devices 9 while it is still fixedly held in place and carries the devices 9 exclusively for the purpose of facilitating convenient removal of neighboring panels (e.g., relatively large and heavy panels 4) in accordance with the method of the present invention. By way of example, the panel 4 in the lower right-hand corner of FIG. 2 can constitute a lightweight panel. Such panel can be thinner than the remaining panels, it can carry a smaller amount of hardware, fewer reinforcing ribs 15 and/or thinner marginal reinforcements (skirts 7). Also, the material of the panel in the lower right-hand corner of FIG. 2 can have a lower specific weight than the material of the other panels.

Of course, the improved panels 4 can be installed or removed by hand as well as by cranes or the like without resorting to the dismantling device or devices 9. This, too, contributes to greater versatility of the form and of its components. For example, the arrangement may be such that the panels 4 can be installed or removed by hand or by resorting to cranes or the like if the dismantling devices 9 are lost or misplaced or are not available at a given locale of use.

Figure 6:
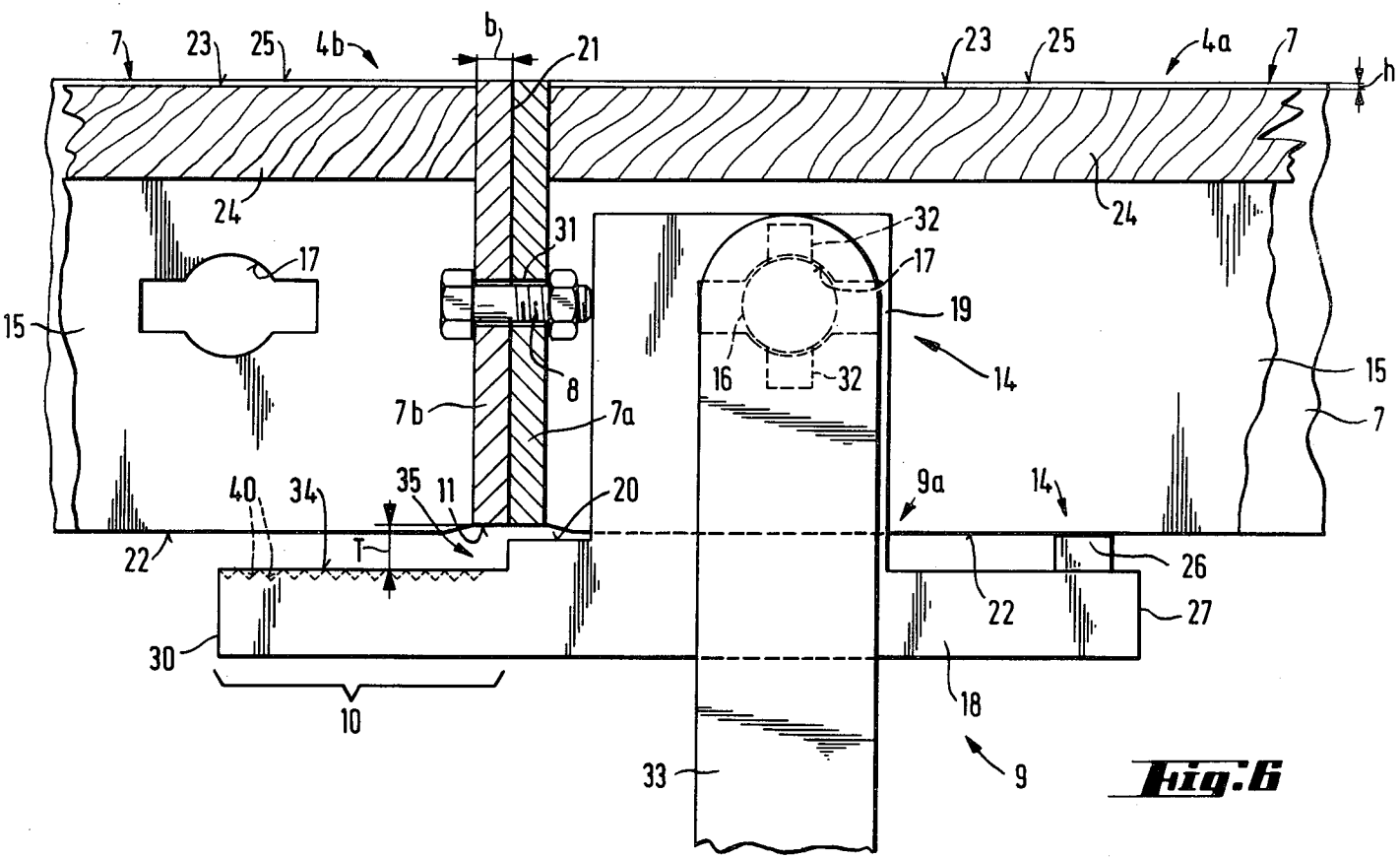
FIG. 6 is a view similar to that of FIG. 3 but showing a modified dismantling device.

FIG. 6 illustrates a modified dismantling device 9 which does not have a pronounced camming portion 13. Instead, the device 9 has a unit 10 whose socket is simply an elongated cutout 35 extending from the unit 9*a* and all the way to the end face 30. The socket or cutout 35 extends from the plane 21 in which the skirts 7*a*, 7*b* of the panels 4*a*, 4*b* abut against each other and below the adjacent portion of the underside 22 of the rib 15 on the panel 4*b*. The depth of the socket or cutout 35 is sufficient to allow for descent of the skirt 7*b* to the position 7*b*′ of FIG. 3 and for subsequent pivoting of the entire panel 4*b* from the position 4*b*′ to the position 4*b*″ of FIG. 3. In further contrast to the design of the dismantling device 9 of FIGS. 1–5, the upper side 20 of the carrier 18 of the device 9 of FIG. 6 is located at a level below and hence out of register with the underside 22 of the respective rib 15 on the panel 4*a*.

The device 9 of FIG. 6 is somewhat simpler than that of FIGS. 1–5 but is also capable of assisting the attendants to carry out the method of the present invention, i.e., to lower a skirt and to thereupon pivot the board 24 of the respective panel to a substantially vertical position for convenient removal from the space below a freshly poured and set concrete roof or the like. The device 9 of FIGS. 1–5 exhibits the advantage that the camming portion 13 allows for convenient rolling or pivoting of the lowered or partially lowered panel to a position (see the position 4*b*″ of the panel 4*b* in FIG. 3) in which the removal of such panel is especially simple and convenient. The panel can be grasped by two workmen and transported to the assembling location for renewed connection with other panels or for transport to storage or elsewhere.

Referring to FIGS. 3 and 6, it will be noted that the right-hand surface flanking the socket 12 or 35 is but need not be flushed with the plane 21, i.e., with the plane in which the two neighboring skirts 7*a* and 7*b* abut against each other when the respective panels 4*a* and 4*b* form part of a partially or fully assembled form. Thus, whereas the socket 12 of FIG. 3 terminates in or very close to an extension of the plane 21, the socket or cutout 35 of FIG. 6 terminates slightly to the right of such plane, i.e., the rightmost portion of the socket 35 is located below the skirt 7*a* of the panel 4*a* shown in FIG. 6. All that counts is to ensure that the skirt 7*b* can readily descend into the socket 12 or 35 (i.e., through the necessary distance T) as soon as it is disconnected from the adjacent skirt 7*a*.

FIG. 6 further shows, by dotted lines, that the bottom surface 34 in the socket 35 can be serrated, toothed, striated or otherwise roughened or made irregular, as at 40. Such irregular formation of the bottom surface 34 reduces the likelihood of accidental slippage of the lowered skirt 7*b* therealong. For example, the irregular formation 40 can consist of a series of teeth or analogous protuberances whose top lands or ridges extend at right angles to the plane of FIG. 6. Such precautionary measure is important, advisable and advantageous when the panels 4*a* and 4*b* are relatively heavy so that accidental slippage of a panel could cause injuries to attendants and/or damage to neighboring equipment or walls.

An important advantage of the improved method and form is that it is now possible to rapidly remove discrete panels 4 or pairs or larger groups of interconnected panels in such a way that the positions of the remaining panels and/or their props remain unchanged. Thus, and in order to remove the left-hand panel (4*b*) of FIG. 3, an attendant merely removes the props 5 and beams 5*a* for such panel as well as the corresponding fasteners 8 and causes or allows the skirt 7*b* to assume the position 7*b*′ whereby the panel 4*b* assumes the position 4*b*′, i.e., the panel 4*b* pivots in the direction of arrow Pf1. Such movement relieves or terminates the stresses upon the panel 4*b* because the latter is thereby lowered below the neighboring panels 4 and 4*a*, i.e., its main portion 24 is moved downwardly and below the underside of the roof 3. In the next step, the panel 4*b* can be moved from the intermediate position 4*b*′ to the position 4*b*″ without any interference on the part of the neighboring panels 4, 4*a* and/or the remaining props 5 and beams 5*a* of the form 1. In other words, the panel 4*b* can be pivoted or rolled to the position 4*b*″ (and thereupon completely removed from the space within the confines of the walls 2 and 3) without necessitating complete and/or partial removal of any props and/or beams other than those which served to support the panel 4*b*.

In assembling the panels 4 into sections 1*a*, 1*b* and/or similar formations outside of the locale of use, each of the panels 4 is placed onto the ground or floor in inverted position, i.e., upside down so that the surface 23 of its major portion 24 rests on a fixed surface. The neighboring panels 4 are then fastened to each other by bolts 8 or the like, and the resulting sections are lifted and inverted by a crane preparatory to placing onto the already erected props 5 and beams 5*a* within the confines of the walls 2. Since the panels can be assembled into larger formations, the absence of ground or a floor below certain panels of the form 1 between the walls 2 presents no problems. i.e., there is no need that each and every panel be supported by one or more props and beams (as long as the number of props and beams suffices to adequately support all of the groups or sections of the form). Moreover, the positions of props 5 and beams 5*a* need not be selected with a high degree of accuracy so that such work can be readily performed by semiskilled or unskilled persons. Entire rows of sections consisting of two, three or more panels can be removed in a simultaneous operation, e.g., in a manner as described above with reference to FIG. 2. However, and even if the panels are removed individually, such work can be completed within a fraction of the time which is needed to dismantle the panels of a form in accordance with heretofore known techniques. Moreover, the removal of individual panels or groups of panels in accordance with the novel method and by resorting to the dismantling devices 9 or 9A is much less likely to involve a risk of injury to the attendants and/or the likelihood of damage to component parts of the form and/or to the building.

The cost of dismantling the form 1 in accordance with the improved method is further reduced due to the fact that the number of panels can greatly exceed the number of dismantling devices 9. This is attributable to the provision of simple, reliable and readily separable connections between the panels and the devices 9 so that such devices can be rapidly transferred from panel to panel so as to allow for stepwise dismantling of the form with a minimal number of (e.g., only two) rather simple, inexpensive, compact and rugged dismantling devices.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. For use in a method of dismantling a form for casting ceiling or roofs of concrete or like materials wherein at least two panels are assembled to define the form and the panels are dismantled subsequent to at least partial hardening of the cast material, the improvement comprising dismantling the panels by mounting a dismantling device having a supporting portion on one of the panels so that the supporting unit extends beneath and defines a gap with the other of the panels; lowering the other panel onto the supporting portion; and pivoting the other panel on the supporting portion to thereby separate the panels.

2. In the improvement of claim 1, wherein said assembling step comprises placing the panels upside down, separably connecting the panels to each other to form at least one group consisting of a plurality of interconnected panels, erecting props for the panels of such group, inverting the group, and placing the inverted group on top of the props.

3. In the improvement of claim 2, wherein said assembling step includes forming at least two groups and said step of placing the inverted group includes establishing a gap between said groups.

4. In the improvement of claim 1, wherein the form comprises more than two panels including a lightweight panel whose weight is less than that of the other panels; and further comprising the step of removing all remaining panels of the form subsequent to removal of the other panel, said removing step including removing the lightweight panel after removal of all other panels.

5. In the improvement of claim 1, further comprising the step of reinforcing at least certain marginal portions of panels in the form.

6. In the improvement of claim 1, wherein the other panel is pivoted downwardly and away from the one panel.

7. In the improvement of claim 1, further comprising the step of removing the dismantling device from the one panel subsequent to the pivoting step.

8. In the improvement of claim 1, comprising the steps of erecting at least one prop for each of the panels prior to casting, and removing the prop for the other panel prior to said lowering step.

9. In the improvement of claim 8, wherein the form comprises more than two panels; and further comprising the steps of removing the props for at least one additional panel which is adjacent to the other panel, disconnecting the additional panel from each neighboring propped panel, lowering the additional panel simultaneously with the other panel, and pivoting the additional panel simultaneously with the other panel.

10. For use in a form for casting ceiling or roof of concrete or like materials wherein at least two panels define a face for confining a flowable, hardenable material, the improvement comprising a dismantling device having a mounting portion and a supporting portion, and connecting means for securing said mounting portion to one of said panels in such a manner that said supporting portion extends beneath and defines a gap with the other of said panels to thereby permit separation of said panels by lowering said other panel onto said supporting portion and pivoting said other panel.

11. In the improvement of claim 10, wherein each of said panels has an opening and said connecting means has a portion extending into said opening in said one panel.

12. In the improvement of claim 10, wherein each of said panels has a plurality of reinforcing elements, said elements including at least two spaced parallel first elements and at least two spaced parallel second elements on each of said panels, said first elements being at least substantially normal to the respective second elements.

13. In the improvement of claim 12, wherein each of said reinforcing elements has a plurality of openings and said connecting means comprises a portion extending into an opening in one of said reinforcing elements on said one panel.

14. In the improvement of claim 10, wherein said supporting portion has a cutout in register with a portion of said other panel.

15. In the improvement of claim 14, wherein a portion of said cutout is in register with a marginal portion of said one panel.

16. In the improvement of claim 14, wherein said supporting portion has an uneven surface constituting the bottom surface of said cutout, a marginal portion of said other panel coming to rest on said uneven surface upon separation of said other panel from said one panel and preparatory to pivoting of said other panel.

17. In the improvement of claim 10, further comprising means for separably connecting said mounting portion to said one panel, including a locking element movable between a first position in which said mounting unit is separable from said one panel and a second position in which said mounting unit is locked to said one panel.

18. In the improvement of claim 17, wherein said locking element is rotatable between said positions thereof.

19. In the improvement of claim 18, wherein said one panel has an opening and said connecting means further comprises a rotatable bolt extending into and through said opening, said locking element comprising a pin extending substantially radially of said bolt and being movable through said opening in said first position but being incapable of passing through said opening in said second position thereof.

20. In the improvement of claim 17, further comprising actuating means for moving said locking element between said positions.

21. In the improvement of claim 20, wherein said locking element is rotatable between said positions thereof and said actuating means comprises a lever and means for connecting said lever with said locking element.

22. In the improvement of claim 21, wherein said lever is rotatable by gravity about a substantially horizontal pivot axis in a direction to move said locking element to said second position.

23. In the improvement of claim 10, wherein said connecting means is designed to separably connect said mounting portion to said one panel.

24. In the improvement of claim 10, wherein said one panel has a reinforcing element and said connecting means is arranged to separably couple said mounting portion to said reinforcing element.

25. In the improvement of claim 10, comprising fastener means for separably securing said panels to each other.

26. In the improvement of claim 25, wherein the distance between said supporting portion and said other panel approximates 8 mm while said panels are fastened to each other.

27. In the improvement of claim 25, wherein said panels have respective first sides which cooperate to define said face and respective second sides located adjacent said device, said panels also having respective marginal portions which are located adjacent one another and are secured to each other by said fastener means.

28. In the improvement of claim 27, wherein said panels have reinforcing skirts provided at said marginal portions thereof and extending beyond said second sides of the respective panels, said skirts having registering openings and said fastener means comprising bolts extending through said registering openings.

29. In the improvement of claim 27, wherein said marginal portions have reinforcing elements extending beyond said second sides of said panels and said fastener means separably connects such elements to each other.

30. In the improvement of claim 27, wherein said marginal portion of said other panel has a reinforcing skirt extending beyond said second side thereof, said second sides constituting the undersides of said panels and said supporting portion having a socket disposed below said skirt, said skirt having a predetermined thickness and said socket having a width at least slightly exceeding said thickness.

31. In the improvement of claim 27, wherein said other panel comprises a reinforcing element extending a predetermined first distance beyond said first side of said other panel and further extending beyond said second side of said other panel and overlying said supporting portion, the distance between said supporting unit and said reinforcing element exceeding said predetermined distance.

32. In the improvement of claim 27, wherein said marginal portions abut against each other in a predetermined plane and said supporting portion has a socket aligned with said marginal portion of said other panel as well as a camming portion adjacent to said socket, said socket being disposed between said camming portion and said mounting unit and said camming portion defining a pivot axis for said other panel subsequent to movement of said marginal portion of said other panel into said socket upon separation of said panels from each other.

33. In the improvement of claim 32, wherein said second sides are the undersides of said panels and said socket has an end located in substantial alignment with said predetermined plane.

34. In the improvement of claim 32, wherein said camming portion has a cam face for said other panel.

35. In the improvement of claim 34, wherein said cam face includes a plurality of mutually inclined portions.

36. In the improvement of claim 35, wherein said mutually inclined portions include a relatively steep first portion immediately adjacent to said socket and at least one less steeply inclined second portion adjacent to said first portion.

37. In the improvement of claim 27, wherein said connecting means is designed to separably connect said mounting portion to said one panel.

38. In the improvement of claim 37, wherein said one panel has an opening and said connecting means comprises a bolt extending into said opening.

39. In the improvement of claim 38, wherein said second sides are the undersides of said panels and said one panel comprises a reinforcing rib having a portion adjacent to said marginal portion of said one panel, said opening being provided in said rib, said other panel having a reinforcing element provided at the respective marginal portion and extending downwardly beyond said second side of said other panel, said reinforcing element having an edge face remote from said second side of said other panel and being spaced apart from said supporting portion of said dismantling device while said panels are connected to each other.

40. In the improvement of claim 39, wherein said mounting portion comprises carrier means extending in substantial parallelism with said rib and an arm rigid with said carrier means and adjacent to said rib, said bolt being provided on said arm and said opening being provided in said rib.

41. In the improvement of claim 40, wherein said bolt is rotatably mounted in and is permanently secured to said arm.

* * * * *